US005195875A

United States Patent [19]

Gaston

[11] Patent Number: 5,195,875

[45] Date of Patent: Mar. 23, 1993

[54] ANTISURGE CONTROL SYSTEM FOR COMPRESSORS

[75] Inventor: John R. Gaston, Allegany, N.Y.

[73] Assignee: Dresser-Rand Company, Corning, N.Y.

[21] Appl. No.: 803,197

[22] Filed: Dec. 5, 1991

[51] Int. Cl.[5] ..... F04B 49/00

[52] U.S. Cl. ..... 417/282; 417/300; 415/27

[58] Field of Search ..... 417/279, 282, 300; 415/1, 26, 27, 28

[56] References Cited

U.S. PATENT DOCUMENTS

| | | | |
|---|---|---|---|
| 3,424,370 | 1/1969 | Law | 415/27 |
| 3,495,418 | 2/1970 | Kapich | 415/27 |
| 4,156,578 | 5/1970 | Agar et al. | 415/1 |
| 4,586,870 | 5/1986 | Hohlweg et al. | 415/1 |
| 4,594,050 | 6/1986 | Gaston | 415/1 |
| 4,594,051 | 6/1986 | Gaston | 415/48 |
| 4,697,980 | 10/1987 | Keyes, IV et al. | 415/1 |
| 4,749,331 | 6/1988 | Blotenberg | 415/47 |
| 4,781,524 | 11/1988 | Blotenberg | 415/27 |
| 4,825,380 | 4/1989 | Hobbs | 364/499 |
| 4,831,535 | 5/1989 | Blotenberg | 364/431.02 |
| 4,861,233 | 8/1989 | Dziubakowski et al. | 417/201 |
| 4,900,232 | 2/1990 | Dzjubakowski et al. | 417/53 |
| 4,936,741 | 6/1990 | Blotenberg | 415/27 |
| 4,944,652 | 7/1990 | Blotenberg | 415/27 |
| 4,946,343 | 8/1990 | Blotenberg | 415/27 |
| 4,948,332 | 8/1990 | Blotenberg | 415/27 |
| 4,949,276 | 8/1990 | Staroselsky et al. | 364/509 |
| 4,971,516 | 11/1990 | Lawless et al. | 415/1 |
| 5,002,459 | 3/1991 | Swearingen et al. | 415/17 |
| 5,042,245 | 8/1991 | Zickwolf, Jr. | 60/39.03 |

FOREIGN PATENT DOCUMENTS 1209057 10/1970 United Kingdom .

*Primary Examiner*—Richard A. Bertsch
*Assistant Examiner*—Charles G. Freay
*Attorney, Agent, or Firm*—Richards, Medlock & Andrews

[57] ABSTRACT

Method and apparatus for operating a compressor to avoid surge conditions. The compressor is controlled by determining a surge line for the compressor as a function of compression ratio and the flow coefficient $(M\sqrt{RTZ})/P_s$; measuring the differential head, h, across a flow element, the suction pressure, $P_s$, and the discharge pressure, $P_d$; generating a process signal that is a function of $P_d/P_s$ and $\sqrt{h/P_s}$ and comparing the process signal with a set point signal to control recycling of discharge flow to the inlet flow to prevent operation of the compressor in surge conditions.

27 Claims, 3 Drawing Sheets

ANTISURGE CONTROL SYSTEM FOR COMPRESSORS

TECHNICAL FIELD OF THE INVENTION

This invention relates to a control system for preventing surge in compressors In one aspect it relates to such a system that can prevent surge in compressors regardless of large swings in the pressure, temperature, or molecular weight of the gas being compressed.

BACKGROUND OF THE INVENTION

Surge is an unstable, pulsating condition that can occur in any compressor that is improperly operated. If the flow rate to the compressor is sufficiently reduced, the compression ratio $P_d/P_s$ where $P_d$ is discharge pressure and $P_s$ is suction pressure, will increase. If the flow decreases too much, the compression ratio will increase to a point where flow reversal occurs inside the compressor which is called "surge." Surge is usually evidenced by an audible boom, piping vibrations, and pressure pulsations. Operation under surge conditions should be avoided because surge can cause thrust bearing failure which can result in rubbing and severe damage to the compressor internals. Overheating due to prolonged surging also causes damage.

The conditions under which a compressor will experience surge is shown on families of performance curves calculated for the compressor. The performance curves include among other items a surge line which indicates at what point surging will occur. A control system must be used to determine if the conditions under which the compressor is operating are approaching the surge line. If so, surge can then be prevented by maintaining a minimum flow through the compressor. Maintaining a minimum flow is accomplished by allowing gas to recirculate through an antisurge valve and recycle line from the compressor's discharge to its inlet. For air and other contaminant free gases, the recycle line is sometimes eliminated and the antisurge valve vents gas to the atmosphere to reduce the compression ratio to prevent surge.

Many prior art antisurge control system typically measure and compute the compressor's operating point relative to a surge line that is determined based on conventional performance curves for various conditions using $P_d$, $P_d-P_s$, $P_d/P_s$, polytropic lead, etc. versus volumetric flow rate squared However, for certain applications, for example, a multistage compressor that must handle extreme gas variations, these prior art control systems will usually have significant measurement errors that can result in inefficient compressor operation and/or failure to prevent surge. This is because these prior art systems do not take into account variation of factors such as the molecular weight of the gas, temperature, compressor speed and/or pressure. Variations in molecular weight are of particular importance where the compressor is to handle different gases with wide variations in molecular weight. The surge line of a compressor determined by conventional methods will vary widely as the molecular weight of the gas changes. This can result in the compressor surging for no apparent reason because the surge line being used to control the compressor becomes incorrect with a shift in the molecular weight of the gas.

Thus, there is a need for an antisurge control system that can prevent surge where variations in molecular weight, pressure and/or temperature will be occurring.

There is a need for a method and apparatus for use in an antisurge control system to accurately measure and compute the compressor's operating point relative to its surge point regardless of wide swings in the molecular weight of the gas.

While the molecular weight of the gas at the inlet of the compressor can be measured to monitor changes in molecular weight, such measurements and use of such measurements can be complicated and lacking in sufficient accuracy. Thus, a need exists for a surge control system that is based on parameters that are easily and accurately measured Likewise, a need exists for a method and apparatus for use in an antisurge control system that can use parameters that are easily and accurately measured to compute the compressor's operating point relative to its surge point.

SUMMARY OF THE INVENTION

The present invention, in one aspect, provides a method and an apparatus for use in an antisurge control system that easily and accurately measures the position of the compressor's operating point relative to the compressor's surge point regardless of wide swings in the molecular weight of the gas being compressed. The method comprises the steps of determining a surge line for the compressor as a function of a flow coefficient $(M\sqrt{RTZ})/P_s$; generating a process signal that indicates the compressor's operating point as a function of the flow coefficient $(M\sqrt{RTZ})/P_s$; and comparing the compressor's operating point with the surge line to determine the position of the compressor's operating point relative to the compressor's surge point.

It has been found that a universal surge line determined for a compressor that is a function of $(M\sqrt{RTZ})/P_s$ does not change with shifts in molecular weight of the gas or other parameters where M is the mass flow rate, R is the universal gas constant, T is the temperature at suction, Z is the compressibility factor at suction and $P_s$ is the suction pressure. Thus, accurate measuring and computing of the position of the compressor's operating point relative to its surge point can be achieved and used in more effectively preventing surge regardless of large changes in molecular weight or other parameters.

It has been determined that $(M\sqrt{RTZ})/P_s$ is proportional to $\sqrt{h/P_s}$ where h is the differential head across a flow element. A signal proportional to $(M\sqrt{RTZ})/P_s$ can be generated by measuring h and $P_s$ and generating a signal proportional to $\sqrt{h/P_s}$. In the preferred embodiment, $P_d$ is measured so that a signal representing $P_d/P_s$ can be generated. Then a process signal is generated that is a function of the difference between the $\sqrt{h/P_s}$ and $P_d/P_s$ signals. The process signal is then compared to a set point signal that corresponds to a set point at a predetermined position relative to the surge line.

In another aspect of the present invention, a method and apparatus for controlling a compressor having a recycle line between its suction and discharge is provided. The apparatus comprises a means for generating a set point signal that corresponds to a set point established at a predetermined position relative to a surge line that is determined for the compressor in terms of the compression ratio $P_d/P_s$ and the flow coefficient $(M\sqrt{RTZ})/P_s$; a means for generating a process signal that corresponds to the operating point of the compressor in terms of $P_d/P_s$ and $(M\sqrt{RTZ})/P_s$; a means for comparing the process signal with the set point signal to determine the position of the compressor's operating point relative to the compressor's surge point; a means for generating a control signal corresponding to the position of the compressor's operating point relative to the compressor's surge point; and a means for modulating flow through the recycle line in response to the control signal so as to avoid surging of the compressor.

DESCRIPTION OF THE PREFERRED EMBODIMENT

Figure 1:
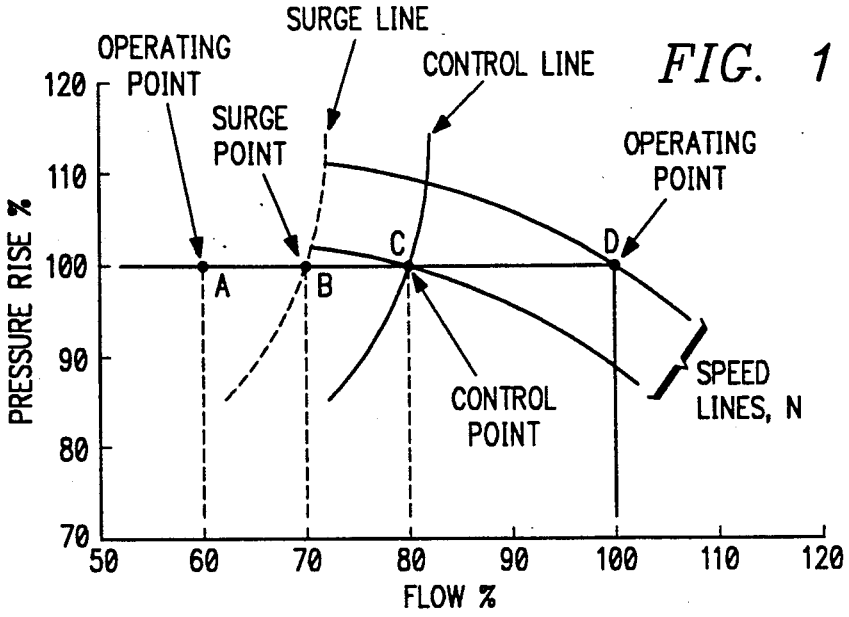
FIG. 1 is a graph showing a conventional plot of a compressor performance curve plotted in terms of pressure rise percent versus flow percent.
Figure 2:
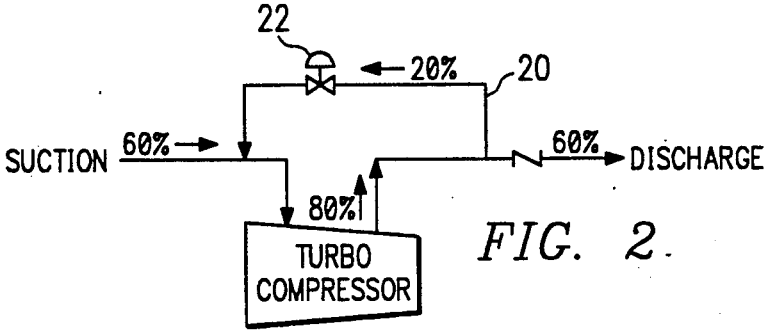
FIG. 2 is a schematic of a compressor system showing how flow at the discharge is recycled to the suction side of the compressor.

Antisurge control systems are used to prevent surge by maintaining a minimum flow through the compressor at a capacity safely more than the capacity at which surge occurs. This is accomplished by allowing some gas to recirculate through a recycle line from the compressor's discharge to its suction Flow through the recycle line is modulated by a valve that responds to the amount of recycle flow needed to maintain the needed flow. FIGS. 1 and 2 illustrate a typical example of reduced capacity operation for a compressor that has a minimum flow limit of 80%. FIG. 1 is a performance curve for the compressor of FIG. 2. The performance curve shows surge point B, control point C and process operating points A and D at 100% discharge pressure. The antisurge control system of FIG. 2 maintains 80% flow through the compressor even though the process requirement is less than 80%. For example, if the process requires only 60% flow, point A on FIG. 1, the antisurge control system in response maintains 20% flow through recycle line 20 by modulating valve 22. Flow through the compressor is equal to the process flow (60%) plus the recycle flow (20%), or 80%, as shown in FIG. 2. Recycle flow will be zero whenever the process is using 80% flow or more.

An accurate measurement system that can determine the position of the compressor's operating point relative to the compressor's surge point is an essential part of any antisurge control system such as described above. Unfortunately, variable gas conditions often cause measurement errors and change the location of the compressor surge line so that a meaningful comparisons between the parameters measured to determine the compressor's operating point and the changing surge line is difficult.

FIG. 1 illustrates a typical performance curve that is made to illustrate one variable at the compressor discharge for a defined set of inlet conditions and rotative speed. The discharge variable of pressure rise percent is used in FIG. 1. The discharge variable is sometimes shown as adiabatic or polytropic head, but more commonly units of pressure or the compression ratio $P_d/P_s$ are used. Gas conditions affect the discharge variable, therefore a curve for each specified group of gas conditions is usually required to properly document the compressor performance when gas conditions are expected to vary. FIG. 1 shows a control line which is set at a position relative to the surge line such that a safety margin is provided in preventing surge. FIG. 1 also shows speed lines for various values of rotative speed of the compressor where N is the RPM of the compressor.

Figure 3:
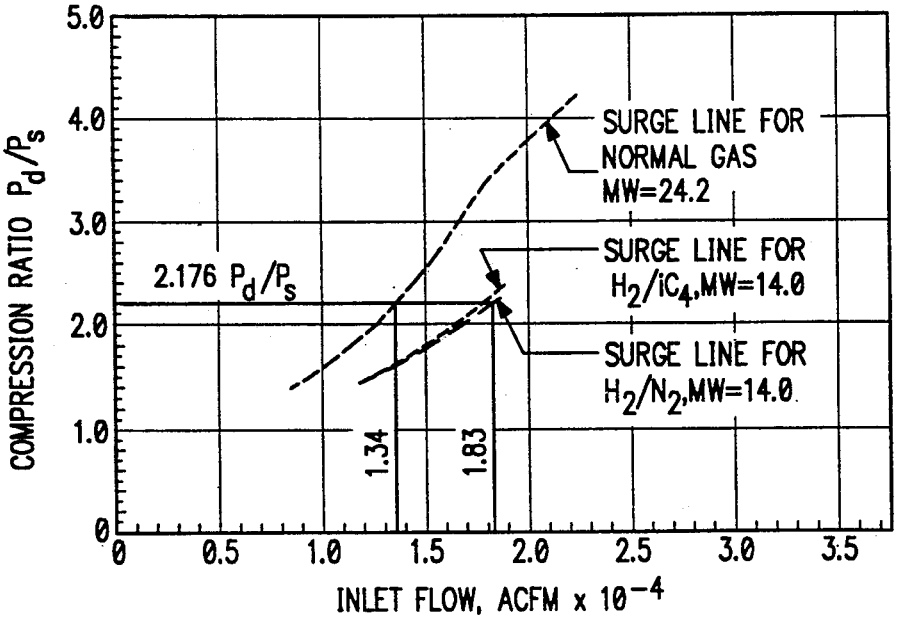
FIG. 3 is a graph showing the different surge lines of a compressor for three different gases plotted in terms of compression ratio versus inlet flow.

FIG. 3 illustrates an example of how the surge line for a compressor shifts due to variations in molecular weight. Speed lines have been omitted from this graph for clarity. FIG. 3 shows the predicted surge lines of a six stage centrifugal compressor for three different gas mixtures plotted together. One gas, the normal gas, has a molecular weight of 24.2 and the two other gases, alternate gases $H_2/N_2$ and $H_2/iC_4$, both have a molecular weight of 14.0. Of particular significance is the difference shapes and locations of the surge lines for these three different gases. From FIG. 3 it can be seen that at a compression ratio of 2.176, surge during operation of the alternate gas mixtures will occur at a flow rate approximately 36% greater than that for the normal gas of 24.2 molecular weight.

The present invention eliminates the above problem by plotting a single, universal surge line for the compressor. It has been found that the universal surge line of the present invention is virtually unaffected by any variations the molecular weight of the gas, compressor speed, temperature and/or pressure. Instead of volumetric flow units as used in FIG. 3, the universal surge line of the present invention uses a flow coefficient of $(M\sqrt{RTZ})/P_s$ where M is the mass flow rate, R is the universal gas constant, T is the temperature at suction, Z is the compressibility factor at suction and $P_s$ is the suction pressure.

Figure 4:
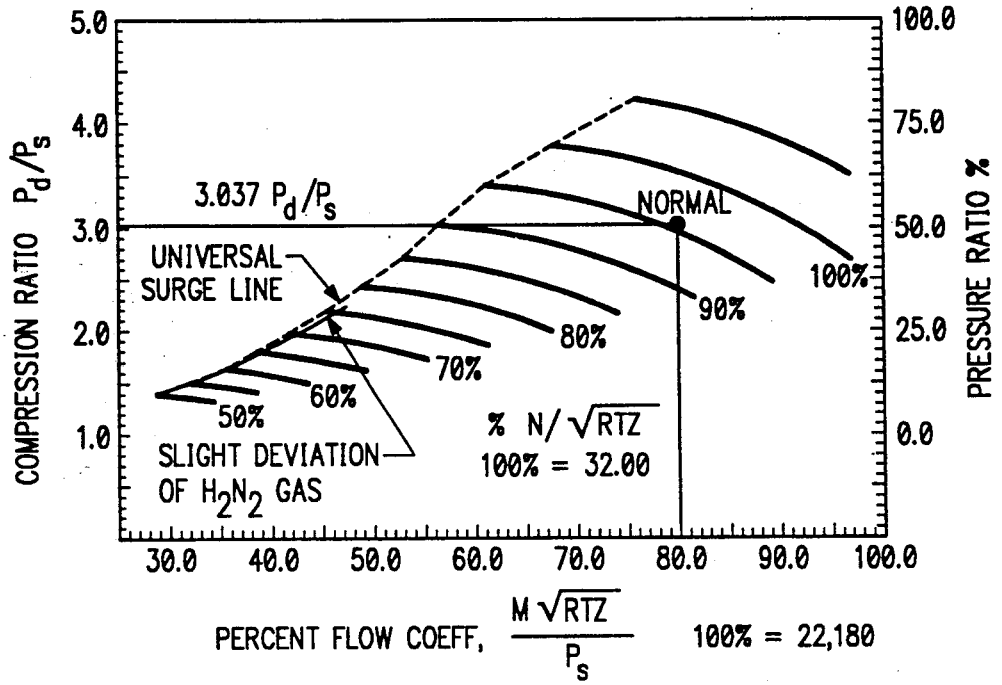
FIG. 4 is a graph showing the universal surge line of the present invention plotted in terms of compression ratio versus percent flow coefficient $(M\sqrt{RTZ})/P_s$ with speed lines $\%N/\sqrt{RTZ}$.

FIG. 4 illustrates the universal surge line for the same compressor as illustrated by FIG. 3. The same three gas mixtures used in the calculations for FIG. 3 were used to produce FIG. 4. Except for a minor deviation for the $H_2/N_2$ gas mixture, the three surge lines from FIG. 3 merge into a single surge line in FIG. 4. Using this universal surge line, the present invention eliminates virtually all errors due to variable gas molecular weight, regardless of how extreme the variations are.

The slight deviation of the $H_2/N_2$ surge line in FIG. 4 is due to a very significant difference in k values, the ratio of specific heat at constant pressure to specific heat at constant pressure to specific heat at constant volume, between $H_2/N_2$ and the other two gases. $H_2/N_2$ has a k value of 1.399 and the normal gas has a k value of 1.158 which is a difference of 0.241. In contrast, $H_2/iC_4$ has a k value of 1.217 which is only a 0.059 difference in k value from the normal gas, and thus it can be seen from FIG. 4 that there is no discernible deviation for $H_2/iC_4$. The $H_2/N_2$ deviation shown in FIG. 4 is approximately the same as the deviation between $H_2/N_2$ and $H_2/iC_4$ shown in FIG. 3. This indicates that the universal surge line of the present invention does not inherently compensate for changes in k value. However, for most applications, the change in k value would be similar to or less than the difference between the $H_2/iC_4$ and normal gas and thus would not be discernible on the universal surge line of the present invention For major changes in k value, such as for $H_2/N_2$, the control system is set to recognize the deviated surge line located at the highest flow rates. This will assure that the compressor is safely protected from surge even though a large change in k value causes only a very minimal surge line deviation.

Performance curves generally include "speed lines" as seen in FIG. 1. These speed lines typically represent N or %N where N is the RPM of the compressor. The speed lines are not important in controlling surge, however, in FIG. 4, the speed lines have been included to show that they represent $\%N\sqrt{RTZ}$ instead of the typical N or %N. FIG. 4 indicates the normal operating being at a compression ratio of 3.037 and percent flow coefficient of 80%.

Figure 5:
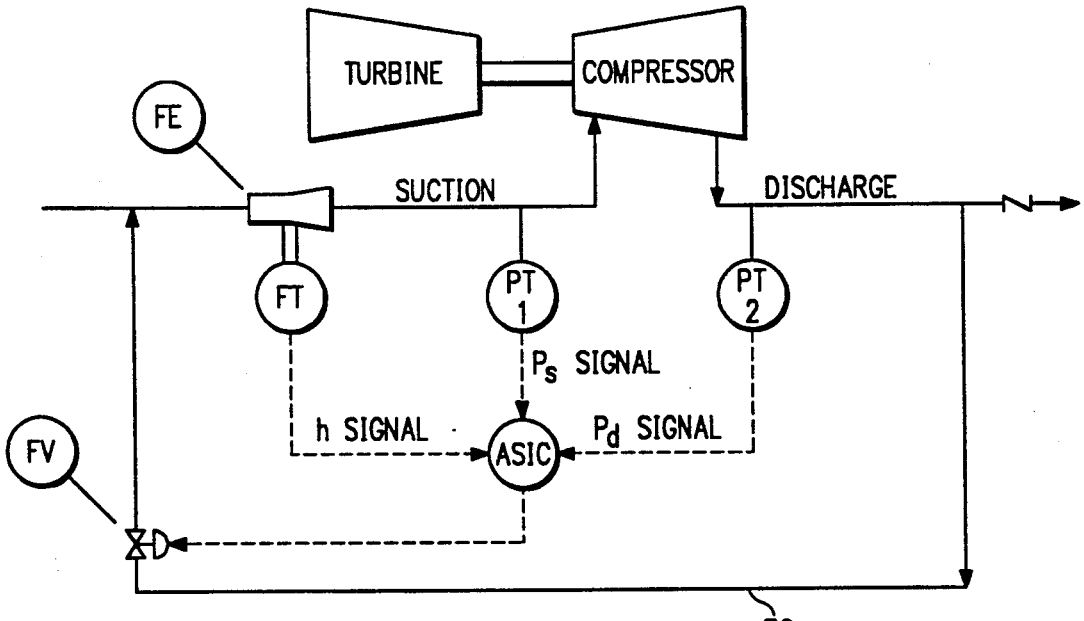
FIG. 5 is a schematic showing the instrumentation used in the antisurge control system of the present invention.

FIG. 5 illustrates the instrumentation used in measuring the flow coefficient as well as the compression ratio. The compression $P_d/P_s$ is easily measured by pressure transmitters PT1 and PT2.

The present invention measures the flow coefficient $(M\sqrt{RTZ})/P_s$ by measuring the parameter $\sqrt{h/P_s}$ where h is the differential head across flow element FE. It has been found that $\sqrt{h/p_s}$ is proportional to $(M\sqrt{RTZ})/P_s$ and thus $(M\sqrt{RTZ})/P_s$ is easily measured with conventional instrumentation. A signal is generated which is proportional to $\sqrt{h/p_s}$ and thus is proportional to $(M\sqrt{RTZ})/P_s$. $\sqrt{h/P_s}$ is proportional to $(M\sqrt{RTZ})/P_s$ as follows:

$$M = K_1\sqrt{h\rho} \tag{1}$$

where $K_1$=proportionality constant, h=flow element differential, and $\rho$=density.

$$\rho = \frac{K_2 P_s}{RTZ} \tag{2}$$

by substitution:

$$\frac{M\sqrt{RTZ}}{P_s} = K_3\sqrt{\frac{hP_s}{RTZ}}\ \frac{\sqrt{RTZ}}{P_s} \tag{3}$$

by cancellation of terms:

$$\frac{M\sqrt{RTZ}}{P_s} = K_3\frac{\sqrt{hP_s}}{P_s} = K_3\sqrt{\frac{h}{P_s}} \tag{4}$$

thus, by measuring h and $P_s$ a process signal can be generated that is proportional to $(M\sqrt{RTZ})/P_s$. $K_2$ and $K_3$ are proportionality constants.

FIG. 5 illustrates the control system of the present invention comprising a primary flow element FE, control valve FV, three transmitters FT, PT1, and PT2 and an antisurge indicating controller ASIC. Control valve FV regulates the recycle gas flow in response to a signal from the antisurge indicating controller ASIC. Flow element FE produces a differential head signal h which is proportional to flow squared in the compressor suction line. Flow transmitter FT transmits a control signal that is proportional to the differential head h, and transmitters PT1 and PT2 transmit signals proportional to the compressor suction and discharge pressures respectively. Discharge flow is recycled through recycle line 30 and is modulated by valve FV in response to the position of the compressor's operating point relative to the compressor's surge point.

In the preferred embodiment, controller ASIC is a single loop digital controller which utilizes a function block principle. Five function blocks are used to generate a process signal that is compared to a set point signal determined from the universal surge line and control line of FIG. 7.

Figure 6:
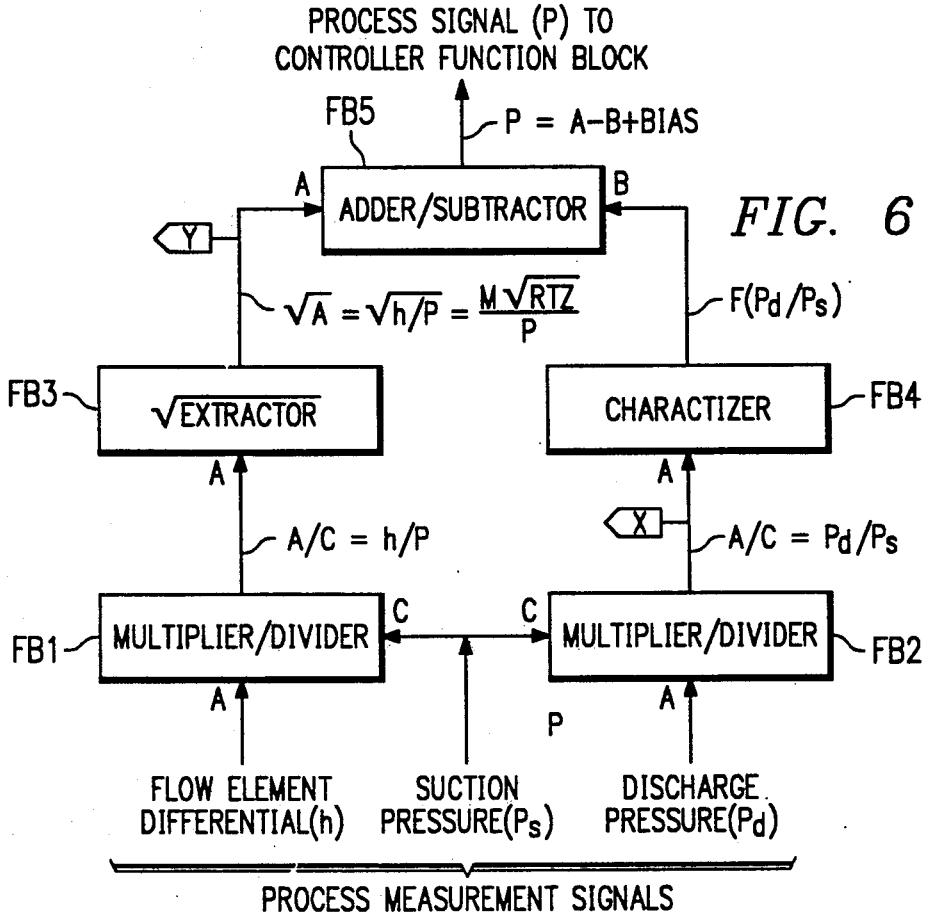
FIG. 6 is a block diagram showing the preferred method of generating a process signal used to control recycling of discharge flow.

FIG. 6 illustrates the schematic arrangement and functions of these five blocks. Multiplier/divider block FB1 and square root extractor FB3 compute the $\sqrt{h/P_s}$ signal which is proportional to $(M\sqrt{RTZ})/P_s$. Multiplier/divider FB2 computes the compression ratio $P_d/P_s$. Characterizer FB4 modifies the $P_d/P_s$ signal as required to be compatible for comparison with a set point signal. The two signals, $\sqrt{h/P_s}$ and modified $P_d/P_s$, are transmitted to an adder-subtracter FB5 which subtracts the modified $P_d/P_s$ signal from $\sqrt{h/P_s}$ and adds a bias to match the scale of the surge line. The output from FB5 is process signal P. Process signal P is transmitted to a proportional-integral controller function block where it is compared with a set point signal corresponding to the predetermined operating point of the compressor. The controller transmits a control signal to valve FV corresponding to the position of the compressor's operating point relative to the surge point.

Figure 7:
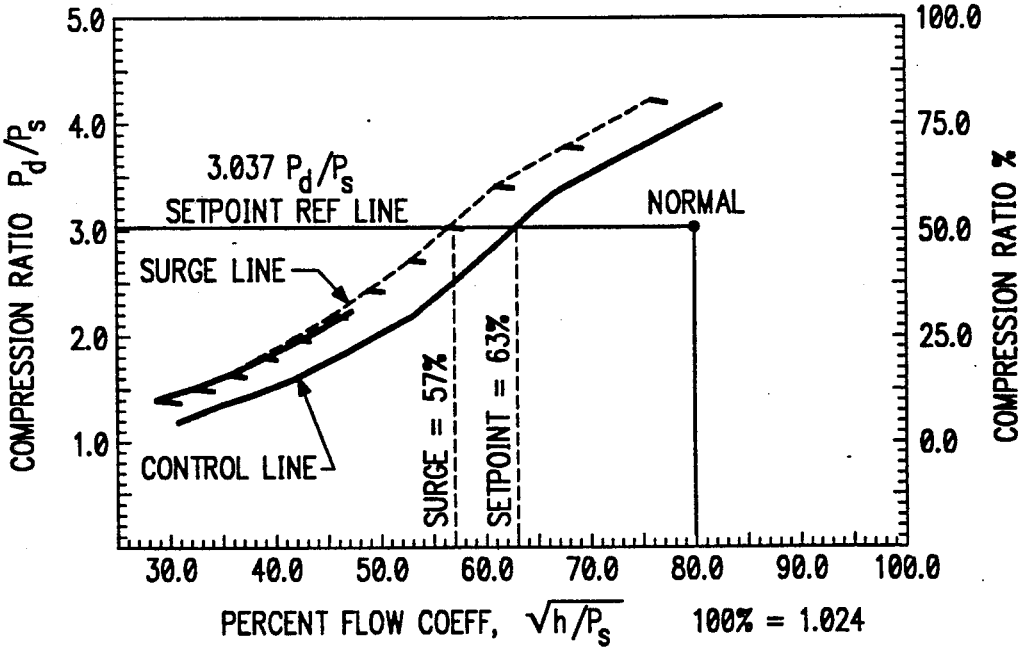
FIG. 7 is a graph showing the universal surge line and a control line of a compressor plotted in terms of compression ratio versus percent flow coefficient $\sqrt{h_s}/P_s$.

FIG. 7 illustrates the surge line for the compressor in relation to a control line. The compressor will surge anywhere above and to the left of the surge line. The process signal P from FB5 will be constant at all points on the surge line because P is a function of the difference between modified $P_d/P_s$ and $\sqrt{h/P_s}$.

Likewise, the process signal from FB5 will be constant for any other line that is parallel with the surge line. The actual value of the process signal for the surge line or any desired control line can be determined from the graph of FIG. 7. The process signal for any line parallel to the surge line will have a value equal to the $\sqrt{h/P_s}$ value at the point where the line intersects the set point reference line. The set point reference line is selected for the compressor's ratio of compression. For example, the surge line intersects the set point reference line at approximately 57% and the control line at 63%. Therefore, a process signal of 57% indicates that a compressor surge is eminent regardless of the pressure ratio. Likewise, a signal at 63% would indicate that the compressor is operating at some point on the control line. For the controller to maintain the minimum flow represented by the control line, a set point signal of 63% would be used.

In an alternative embodiment, FB5 can be eliminated and the signals from FB3 and FB4 are used as the process and set point signals respectively which are transmitted to the controller function block.

Even in the preferred embodiment, the signals from FB2 and FB3 can also be transmitted to continuously show the compressor operating point on a universal performance curve displayed on a CRT screen. This is shown in FIG. 6 with the "X" and "Y" lines coming from FB2 and FB3, respectively.

In operation, a surge line for the compressor to be controlled is determined as a function of $P_d/P_s$ versus $M\sqrt{RTZ}/P_s$. Because $M\sqrt{RTZ}/P_s$ is proportional to $\sqrt{h/P_s}$, the X-axis can optionally be in terms of $\sqrt{h/P_s}$.

The set point reference line is then established at the rated compression ratio for the compressor. The value of $(M\sqrt{RTZ})/P_s$, or $\%M\sqrt{RTZ}/P_s$ if preferred for convenience, where surge will occur is the value where the set point reference line intersects the surge line. A safety margin is then added to this value to establish a set point, or control point. The line that crosses the set point, or control point, and that is parallel to the surge line is the control line. A set point signal corresponding to the set point is generated.

During operation of the compressor h, $P_d$ and $P_s$ are measured and $\sqrt{h/P_s}$ and $P_d/P_s$ signals are generated. A process signal is generated from these signals that corresponds to where the compressor is operating in terms of $\sqrt{h/P_s}$ and $M\sqrt{RTZ}/P_s$. The process signal is compared to the set point signal and a control signal is generated that corresponds to the position of the compressor's operating point relative to the set point. If the operator's point is greater than the set point then valve FV can remain closed. If the operating point is less than the set point the valve FV is opened relative to the magnitude of the difference represented by the control signal such that discharge flow through recycle line 30 is sufficient to raise the operating point back to the value of the set point such that the compressor does not operate too close to its surge point that is below the set point.

The universal surge line used in the present invention takes into account all of the variables that appreciably affect the surge line. This enables the present invention to have virtually zero measurement error regardless of the parameters that vary.

In some applications, the flow element FE is on the discharge side of the compressor due to various impracticalities of placing it on the suction side. If this is the case, any error due to variations in k value can be significant. To eliminate this error, a temperature ratio correction factor is added. The flow coefficient for the universal surge line would then be $(T_s/T_d)(M\sqrt{RT_dZ})/P_d$, and $(T_s/T_d)]h_d/\sqrt{P_d}$ would be proportional and easily measured where $T_s$ is temperature at suction, $T_d$ is temperature at discharge and $h_d$ is differential head from a flow element on the discharge side.

Although the present invention has been described with respect to a preferred embodiment, various changes, substitutions and modifications may be suggested to one skilled in the art and it is intended that the present invention encompass such changes, substitutions and modifications as fall within the scope of the appended claims.

I claim:

1. A method for determining the position of a compressor's operating point relative to the compressor's surge point, comprising the steps of:

(a) determining a surge line for the compressor as a function of a flow coefficient $(M\sqrt{RTZ})/P_s$;

(b) generating a process signal that indicates the compressor's operating point as a function of the flow coefficient $(M\sqrt{RTZ})/P_s$; and (c) comparing the compressor's operating point with the surge line to determine the position of the compressor's operating point relative to the compressor's surge point.

2. The method of claim 1 wherein the step of comparing the compressor's operating point with the compressor's surge point comprises the steps of:

(a) generating a set point signal that corresponds to a set point at a predetermined position relative to the surge line;

(b) comparing the process signal with the set point signal.

3. The method of claim 1 wherein the surge line is determined also as a function of the compression ratio $P_d/P_s$.

4. The method of claim 1 wherein the step of generating a process signal comprises the steps of:

(a) sensing the differential head produced by a flow element and generating a differential head signal proportional to the differential head;

(b) sensing the suction pressure of the compressor and generating a suction pressure signal proportional to the suction pressure; and (c) calculating $\sqrt{h/P_s}$ from the differential head signal and the suction pressure signal; and (d) generating the process signal proportional to $\sqrt{h/P_s}$.

5. The method of claim 2 wherein the step of generating a set point signal comprises the steps of:

(a) plotting the surge line as a function of $(M\sqrt{RTZ})/P_s$ versus compression ratio $P_d/P_s$;

(b) selecting a set point reference line at a particular compression ratio;

(c) setting the set point on the set point reference line at a predetermined position relative to the surge line; and (d) generating the set point signal to correspond to the position of the set point.

6. The method of claim 2 wherein the predetermined position of the set point relative to the surge line is adjustable during operation of the compressor.

7. A method for controlling a compressor having a recycle line between its suction and discharge, comprising the steps of:

(a) determining a surge line for the compressor as a function of a flow coefficient $(M\sqrt{RTZ})/P_s$;

(b) generating a process signal that indicates the compressor's operating point as a function of the flow coefficient $(M\sqrt{RTZ})/P_s$;

(c) comparing the compressor's operating point with the surge line to determine the position of the compressor's operating point relative to the compressor's surge point;

(d) generating a control signal corresponding to the position of the compressor's operating point relative to the compressor's surge point; and (e) modulating flow through the recycle line in response to the control signal so as to avoid surging of the compressor.

8. The method of claim 7 wherein the step of comparing the compressor's operating point with the compressor's surge point comprises the steps of:

(a) generating a set point signal that corresponds to a set point at a predetermined position relative to the surge line; and (b) comparing the process signal with the set point signal.

9. The method of claim 7 wherein the surge line is determined also as a function of the compression ratio $P_d/P_s$.

10. The method of claim 7 wherein the step of generating a process signal comprises the steps of:

(a) sensing the differential head produced by a flow element and generating a differential head signal proportional to the differential head;

(b) sensing the suction pressure of the compressor and generating a suction pressure signal proportional to the suction pressure;

(c) calculating $\sqrt{h/P_s}$ from the differential head signal and the suction pressure signal; and (d) generating the process signal proportional to $\sqrt{h/P_s}$.

11. The method of claim 8 wherein the step of generating a set point signal comprises the steps of:

(a) plotting the surge line as a function of $(M\sqrt{RTZ})/P_s$ versus compression ratio $P_d/P_s$;

(b) selecting a set point reference line at a particular compression ratio;

(c) setting the set point on the set point reference line at a predetermined position relative to the surge line; and (d) generating the set point signal to correspond to the position of the set point.

12. The method of claim 8 wherein the predetermined position of the set point relative to the surge line is adjustable during operation of the compressor.

13. A method for controlling a compressor having a recycle line between its suction and discharge, comprising the steps of:

a) determining a surge line for the compressor that is a function of compression ratio, $P_d/P_s$, and flow coefficient, $(M\sqrt{RTZ})/P_s$;

b) sensing the differential head produced by a flow element and generating a differential head signal proportional to the differential head;

(c) sensing the discharge pressure of the compressor and generating a discharge pressure signal proportional to the discharge pressure;

d) sensing the suction pressure, of the compressor and generating a suction pressure signal proportional to the suction pressure;

e) generating a first signal proportional to $(M\sqrt{RTZ})/P_s$ from the differential head signal and the suction pressure signal;

f) generating a second signal proportion to $P_d/P_s$ from the discharge pressure signal and the suction pressure signal;

g) comparing the first signal and the second signal with the surge line to generate a control signal corresponding to the position of the compressor's operating point relative to the compressor's surge point; and (h) modulating flow in the recycle line in response to the control signal so as to avoid surging of the compressor.

14. The method of claim 13 wherein the step of comparing the first signal and the second signal with the surge line comprises the steps of:

a) establishing a set point reference line at a particular compression ratio of the compressor;

b) selecting a set point on the set point reference line at a predetermined position relative to the surge line;

c) generating a process signal that is a function of the first signal and the second signal that reflects where the compressor is operating along the set point reference line; and d) comparing the process signal with the set point.

15. The method of claim 13 wherein the step of generating a first signal proportional to $(M\sqrt{RTZ})/P_s$ comprises the steps of:

(a) dividing the suction pressure signal into the differential head signal to generate a $h/P_s$ signal; and (b) extracting the square root of the $h/P_s$ signal to generate a $\sqrt{h/P_s}$ signal which si proportional to $(M\sqrt{RTZ})/P_s$.

16. The method of claim 13 wherein the step of comparing the first signal and the second signal with the surge line comprises the steps of:

(a) generating a set point signal that corresponds to a set point established at a predetermined position relative to the surge line;

(b) generating a process signal that is a function of the first signal and the second signal so as to indicate the compressor's operating point in terms of $P_d/P_d$ and $(M\sqrt{RTZ})/P_s$; and (c) comparing the process signal with the set point signal.

17. The method of claim 16 wherein the process signal is a function of the difference between the first signal and the second signal.

18. The method of claim 17 wherein the process signal is the first signal minus the second signal, the second signal modified to properly characterize the second signal in relation to the surge line.

19. The method of claim 18 wherein a bias is added to the difference between the first signal and the modified second signal so that the process signal corresponds to the scale of the surge line.

20. An apparatus for determining the position of a compressor's operating point relative to the compressor's surge point, comprising:

(a) a means for generating a set point signal that corresponds to a set point that is at a predetermined position relative to a surge line of the compressor that is a function of a flow coefficient $(M_{29\ RTZ)/Ps}$;

(b) a means for generating a process signal that indicates the compressor's operating point as a function of the flow coefficient $(M\sqrt{RTZ})/P_s$; and (c) a means for comparing the process signal with the set point signal for determining the position of the compressor's operating point relative to the compressor's surge point.

21. The apparatus of claim 20 wherein the surge line is also a function of the compression ratio $P_d/P_s$.

22. The apparatus of claim 20 wherein the means for generating a process signal comprises:

(a) a means for sensing the differential head produced by a flow element and generating a differential head signal proportional to the differential head;

(b) a means for sensing the suction pressure of the compressor and generating a suction pressure signal proportional to the suction pressure;

(c) a means for calculating $\sqrt{h/P_s}$ from the differential head signal and the suction pressure signal; and (d) a means for generating the process signal proportional to $\sqrt{h/P_s}$.

23. An apparatus for controlling a compressor having a recycle line between its suction and discharge, comprising the steps of:

(a) a means for generating a set point signal that corresponds to a set point that is at a predetermined position relative to a surge line of the compressor that is a function of a flow coefficient $(M\sqrt{RTZ})/P_s$;

(b) a means for generating a process signal that indicates the compressor's operating point as a function of the flow coefficient $(M\sqrt{RTZ})/P_s$; and (c) a means for comparing the compressor's operating point with the surge line for determining the position of the compressor's operating point relative to the compressor's surge point;

(d) a means for generating a control signal corresponding to the position of the compressor's operating point relative to the compressor's surge point; and (e) a means for modulating flow through the recycle line in response to the control signal so as to avoid surging of the compressor.

24. The apparatus of claim 23 wherein the surge line is also a function of the compression ratio $P_d/P_s$.

25. The apparatus of claim 23 wherein the means for generating a process signal comprises:

(a) a means for sensing the differential head produced by a flow element and generating a differential head signal proportional to the differential head;

(b) a means for sensing the suction pressure of the compressor and generating a suction pressure signal proportional to the suction pressure;

(c) a means for calculating $\sqrt{h/P_s}$ from the differential head signal and the suction pressure signal; and (d) a means for generating the process signal proportional to $\sqrt{h/P_s}$.

26. An apparatus for controlling a compressor having a recycle line between its suction and discharge, comprising:

a) a means for generating a set point signal corresponding to a surge line for the compressor that is a function of compression ratio $P_d/P_s$ and flow coefficient $(M\sqrt{RTZ})/P_s$;

b) a means for sensing the differential head produced by a flow element and generating a differential head signal proportional to the differential head;

c) a means for sensing the discharge pressure of the compressor and generating a discharge pressure signal proportional to the discharge pressure;

d) a means for sensing the suction pressure of the compressor and generating a suction pressure signal proportional to the suction pressure;

e) a means for generating a first signal proportional to $(M\sqrt{RTZ})/P_s$ from the differential head signal and the suction pressure signal;

f) a means for generating a second signal proportional to $P_d/P_s$ from the discharge pressure signal and the suction pressure signal;

g) a means for comparing the first signal and the second signal with the set point signal to generate a control signal corresponding to the position of the compressor's operating point relative to the compressor's surge point; and (h) a means for modulating flow in the recycle line in response to the control signal so as to avoid surging of the compressor.

27. The method of claim 26 wherein the means for generating a first signal proportional to $(M\sqrt{RTZ})/P_s$ comprises:

(a) a means for dividing the $P_s$ signal into the differential head signal to generate a $h/P_s$ signal; and (b) a means for extracting the square root of the $h/P_s$ signal to generate a $\sqrt{h/P_s}$ signal which is proportional to $(M\sqrt{RTZ})/P_s$.

* * * * *